US006443851B1

(12) United States Patent
Liberatore

(10) Patent No.: US 6,443,851 B1
(45) Date of Patent: Sep. 3, 2002

(54) WEIGHT HOLDER ATTACHABLE TO GOLF CLUB

(76) Inventor: Raymond A. Liberatore, 12143 Punkin Hollow Rd., Bentonville, AR (US) 72713

( * ) Notice: Subject to any disclaimer, the term of this patent is extended or adjusted under 35 U.S.C. 154(b) by 0 days.

(21) Appl. No.: 09/799,913

(22) Filed: Mar. 5, 2001

(51) Int. Cl.[7] ..... A63B 69/36
(52) U.S. Cl. ..... 473/256; 150/160; 273/DIG. 30
(58) Field of Search ..... 473/256, 231, 473/238, 242, 437, 524, 553; 273/DIG. 30; 150/160; 206/315.4

(56) References Cited

U.S. PATENT DOCUMENTS

| | | | | |
|---|---|---|---|---|
| 1,674,136 | A | | 6/1928 | Shidler |
| 2,676,803 | A | * | 4/1954 | Damaske |
| 2,737,394 | A | | 3/1956 | Abel |
| 3,145,749 | A | * | 8/1964 | Rosenow |
| 3,231,281 | A | | 1/1966 | Wallo |
| 3,398,961 | A | * | 8/1968 | Higdon |
| 3,593,769 | A | * | 7/1971 | Spears |
| 4,213,614 | A | * | 7/1980 | Philippi |
| 4,602,788 | A | | 7/1986 | Wendt |
| 4,842,280 | A | * | 6/1989 | Hilton |
| 5,000,238 | A | * | 3/1991 | Zeller |
| 5,230,512 | A | | 7/1993 | Tuttershell |
| 5,294,127 | A | * | 3/1994 | Keelan |
| 5,403,009 | A | | 4/1995 | Gleason, Jr. |
| 5,527,038 | A | | 6/1996 | Mabie |
| 5,609,531 | A | | 3/1997 | Gates |
| 5,615,720 | A | * | 4/1997 | Osullivan |
| 5,776,006 | A | | 7/1998 | Gruber |
| 6,015,354 | A | | 1/2000 | Ahn et al. |
| 6,065,516 | A | * | 5/2000 | Chang |
| 6,083,116 | A | | 7/2000 | Loredo |
| 6,102,810 | A | | 8/2000 | Boland |
| 6,120,385 | A | | 9/2000 | Nemeckay |
| 6,126,556 | A | | 10/2000 | Hsieh |

* cited by examiner

*Primary Examiner*—Sebastiano Passanti
(74) *Attorney, Agent, or Firm*—William W. Haefliger

(57) ABSTRACT

A weighting device for use on a golf club head as during swinging of the club, comprising in combination, a receptacle having an opening via which the club head is received into the receptacle, a retainer carried on the receptacle to be fastened in a position for retaining the receptacle in fitting relation to the club head, and weighting structure carried by the receptacle to add substantial weight to the club head weight, for use as in club head swinging.

19 Claims, 6 Drawing Sheets

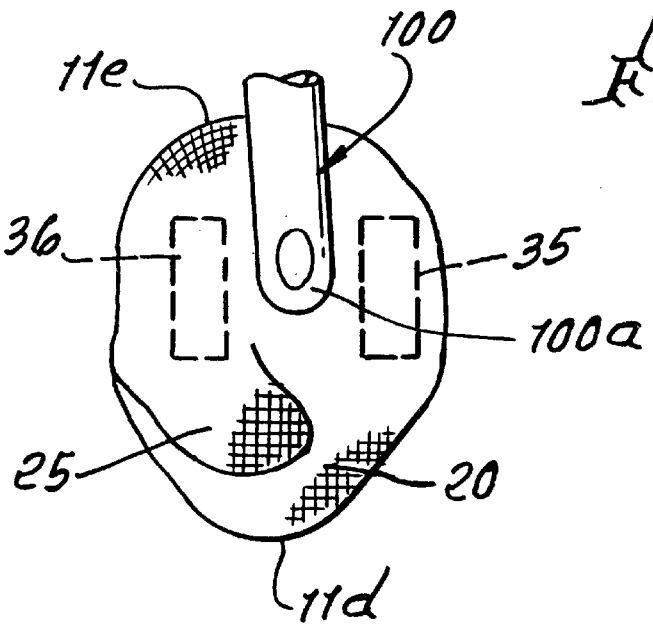
FIG. 3.
FIG. 4.
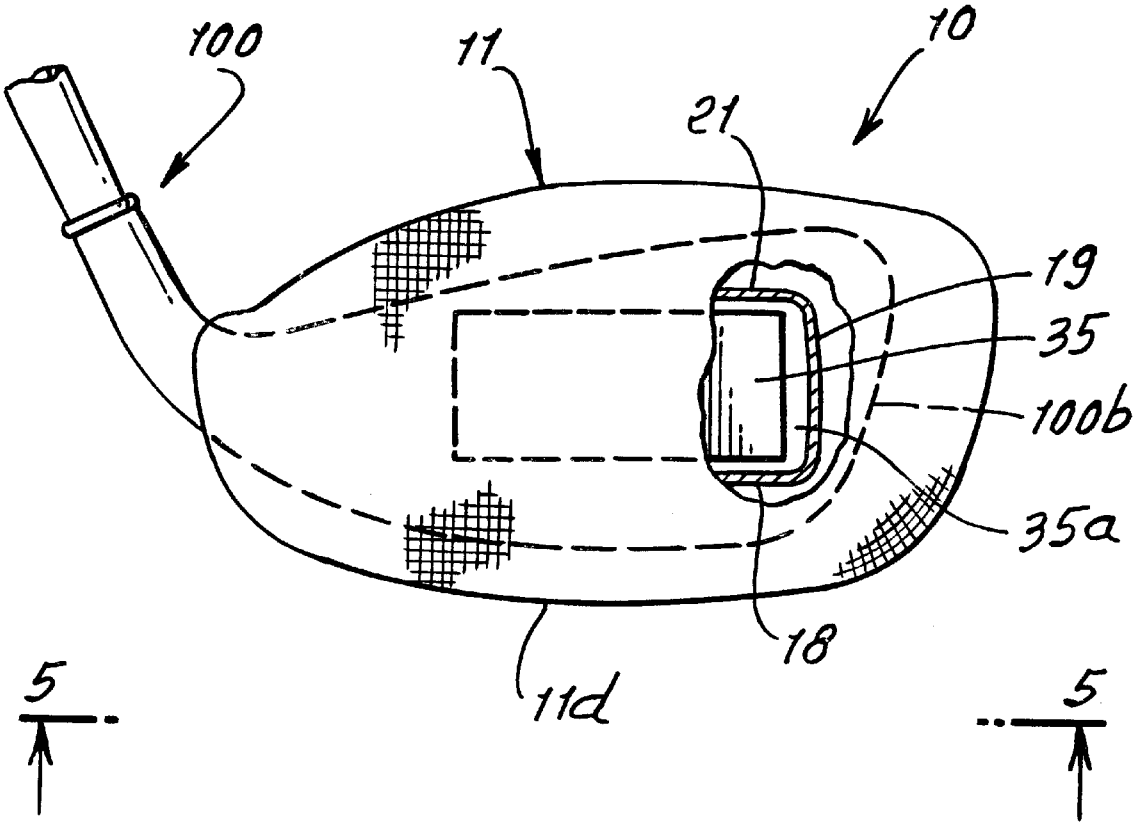

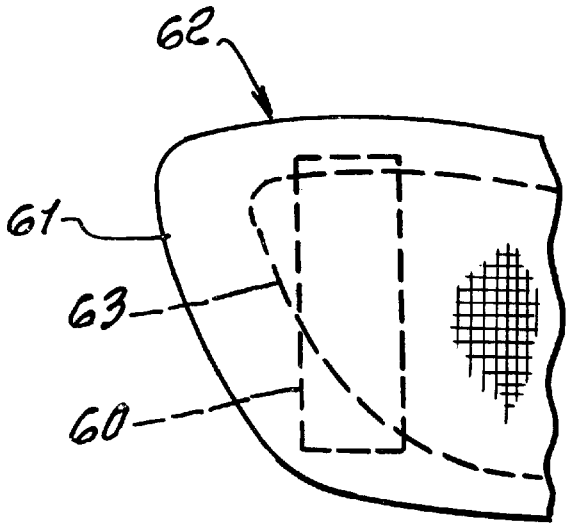
FIG. 7.
FIG. 8.
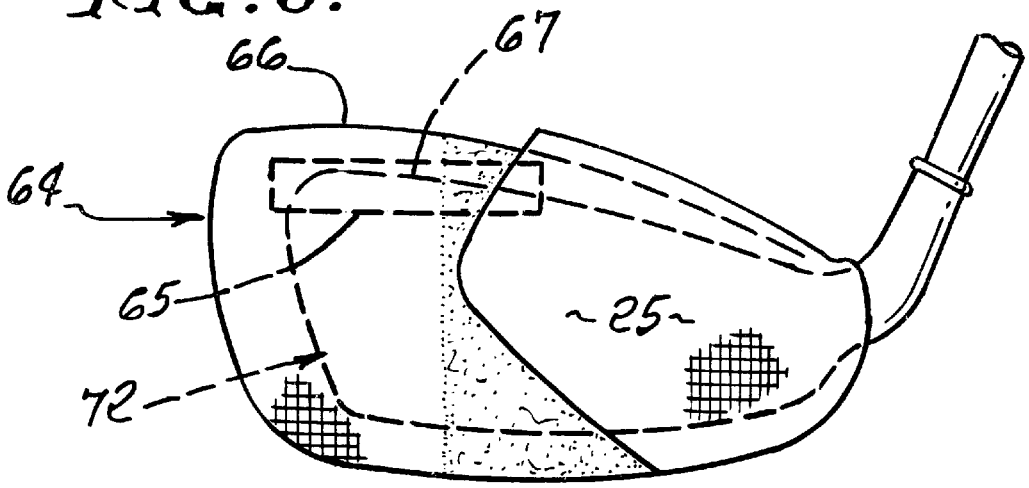
FIG. 9.
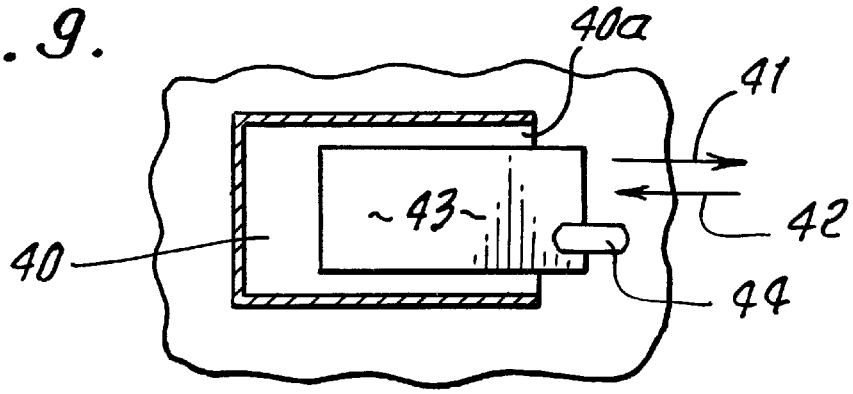

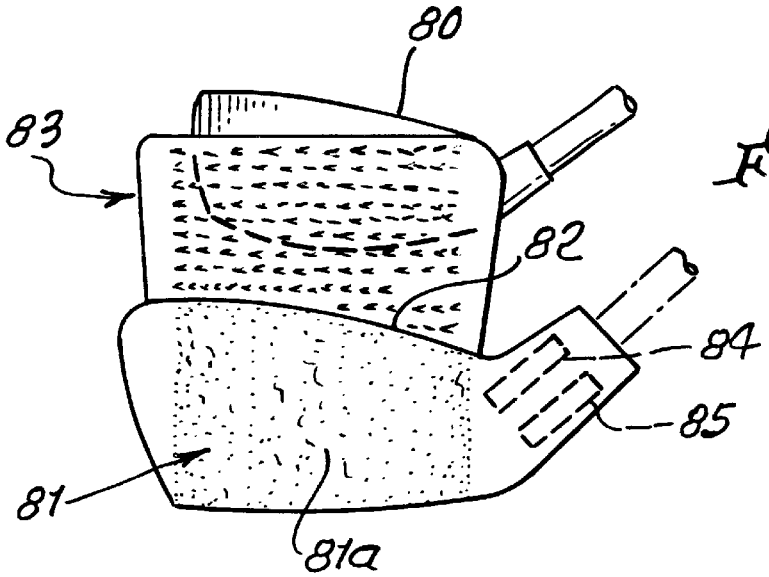
FIG. 10.
FIG. 11.
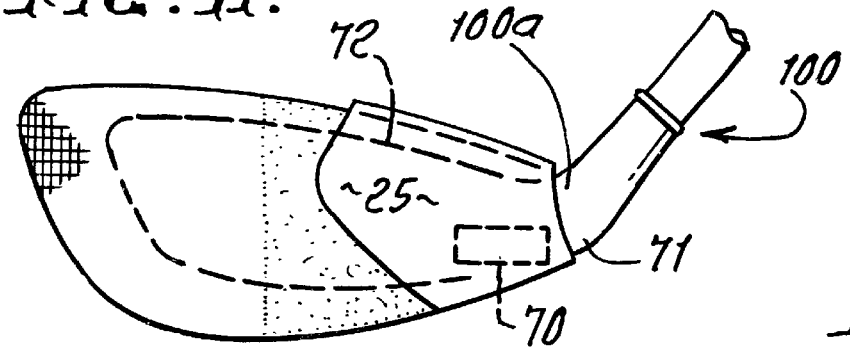
FIG. 12.
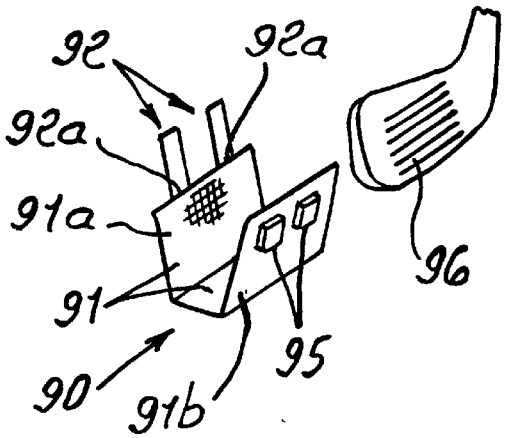
FIG. 13.
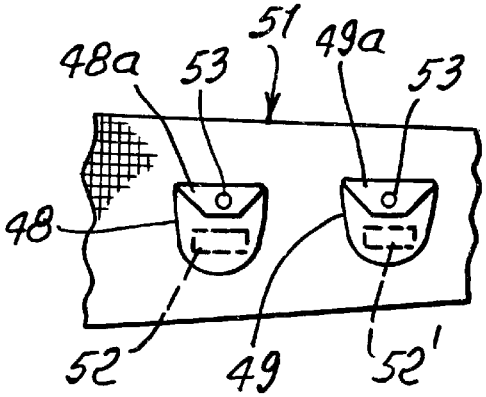

WEIGHT HOLDER ATTACHABLE TO GOLF CLUB

BACKGROUND OF THE INVENTION

This invention relates generally to swinging of golf clubs, as for example irons; and more particularly concerns removably adding weight to a golf club, and particularly at the club head, such as at a selectable location or locations proximate the head.

When golfers warm-up, or train, they commonly use two clubs, such as irons, and swing them in unison a few times to loosen muscles. Holding and swinging two clubs is awkward, uncomfortable, and does not achieve the right feel, needed as by gripping and swinging only one club; but one club does not achieve additional weight as can be provided by two clubs. There is need to overcome this dilemma, in a simple, effective and efficient manner, as is now provided by the present invention.

SUMMARY OF THE INVENTION

It is a major object of the invention to provide a simple and effective weighting device meeting the above need, for golf clubs. Basically, the device comprises:

a) a receptacle having an opening via which the club head is received into the receptacle, b) a retainer carried on the receptacle to be fastened in a position for retaining the receptacle in fitting relation to the club head, c) and weighting structure carried by the receptacle to add substantial weight to the head weight, for use as in club swinging.

As will be seen, the retainer preferably comprises a flap or strap carried to extend at least part way about the receptacle, when closed on a golf club head, and hook and pile fastening material such as VELCRO may be provided to adhere the flap or strap in fastening position.

Another object includes provision of a receptacle having at least two of the following:

i) a wall portion to extend adjacent the front face of the club head ii) a wall portion to extend adjacent the rear side of the club head iii) a wall portion to extend adjacent the bottom surface of the club head iv) a wall portion to extend adjacent the toe of the club head v) a wall portion to extend adjacent the heel of the club head vi) a wall portion to extend adjacent the top edge of the club head;

and the weighting structure is located at or proximate at least one of such wall portions.

Further, the weighting structure is typically located proximate one of the following:

vii) at least one of the wall portions, viii) at least two of the wall portions, ix) at least three of the wall portions, x) at least four of said wall portions.

In addition, the weighting structure typically includes metallic material, solid or flowable; it is typically concealed by the receptacle; and it may include separate localized metallic portions. It may be sewn or otherwise held in a pocket or pockets provided by the receptacle, and at opposite sides of a club head retained in the receptacle.

Yet another object includes location of the weighting material in a pocket provided by the receptacle, the pocket sized to enable adjustment of the position of the material, relative to the pocket; and in this regard the pocket or pockets may enable selective use of the material in one or more pockets, for adjustable weighting, as to positioning, or as to selected weighting; or both. The receptacle may be sized to fit different or all sizes of heads.

A further object is to provide a receptacle as for reception of any golf club iron head, or wedge head, or other head; and for use of the receptacle on a head as a swing trainer, or to cure a slice or hook; or to help "release" of the club during warm-up; or to increase golfer muscle strengths or flexibility and/or to improve tempo, and/or swing speed, and/or wrist action.

These and other objects and advantages of the invention, as well as the details of an illustrative embodiment, will be more fully understood from the following specification and drawings, in which:

DRAWING DESCRIPTION

FIG. 3 is a heel end elevation taken on lines 3—3 of FIG. 1;

FIG. 4 is a rear side elevation taken on lines 4—4 of FIG. 2;

FIG. 7 is a fragmentary elevation showing a weight structure carried by a club head receptacle, near the toe end of the receptacle and club head;

FIG. 8 is a fragmentary elevation showing a weight structure carried by a club head receptacle, near the top of the receptacle and club head;

FIG. 9 is a side elevation showing removability of a weight structure, from a club head and/or adjustability of the weight structure;

FIG. 10 is a side elevation showing weight structures carried by a club head receptacle, adjacent the head hosel;

FIG. 11 is a side elevation showing a weight structure carried by a club head receptacle adjacent the heel of the receptacle and club head;

FIG. 12 is a side elevation showing co-operating weight structure on a carrier to be attached to a golf club head as by folding straps, FIGS. 13–15 show modifications.

DETAILED DESCRIPTION

Figure 1:
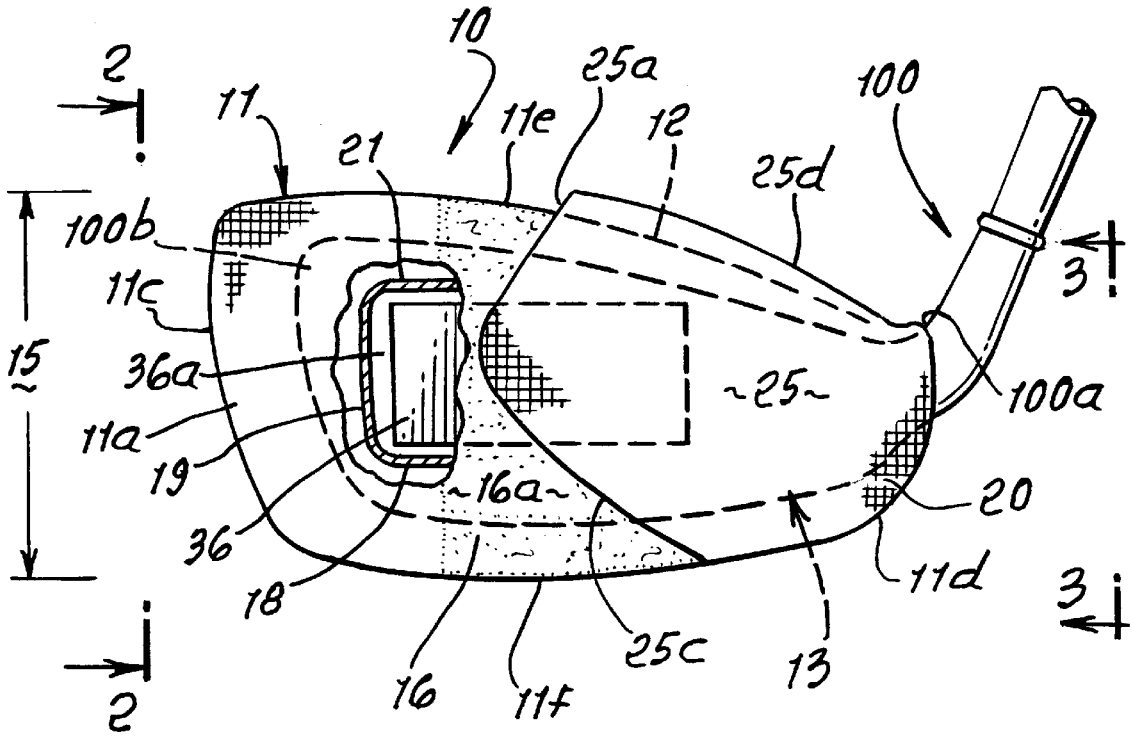
FIG. 1 is a side elevation showing a head receptacle enveloping a golf club head, with a retainer wrapped over a side of the receptacle near the club hosel.

Referring to FIGS. 1–6, a weight holder device is shown at 10, for use on a golf club 100 as during warm-up swinging of the club. It includes a receptacle 11 having an opening 12 via which, or through which, a golf club head 13 is received. The receptacle has a front side 11*a*, a rear side 11*b*, a toe end 11*c*, a heel at 11*d*, a top 11*e*, and a bottom 11*f*. In this example, and referring to FIG. 6, the opening 12 extends in the top 11*e*, and in the upper extent of the receptacle, and may have a long dimension indicated at 14. That dimension is typically greater than the maximum height dimension 15 of the head, to allow 104 entry of the head, endwise, through the opening, and into the receptacle, as well as removal from the receptacle. The receptacle typically consists of flexible fabric or material which is tough and durable, as for example synthetic resinous (plastic) material.

The receptacle preferably has wall portions, and typically at least two of the following:

i) a front side or first inner wall portion 16 to extend adjacent, or proximate the face of the golf club head;

ii) a rear side or second inner wall portion 17 to extend adjacent or proximate the club head rear side;

iii) a lower or third wall portion 18 to extend adjacent the elongated bottom surface of the club head;

iv) a forward or fourth wall portion 19 extend forwardly of or adjacent the toe of the club head;

v) a rearward or fifth wall portion 20 to extend adjacent or proximate the heel of the club head;

vi) a top or sixth wall portion 21 to extend adjacent or proximate the top edge of the club head.

The receptacle further defines an interior slot 22 receiving the club head, as for example an iron.

As will be seen, a retainer is carried on the receptacle to be extended and fastened in a position for retaining the receptacle in close fitting relation to the club head.

Figure 2:
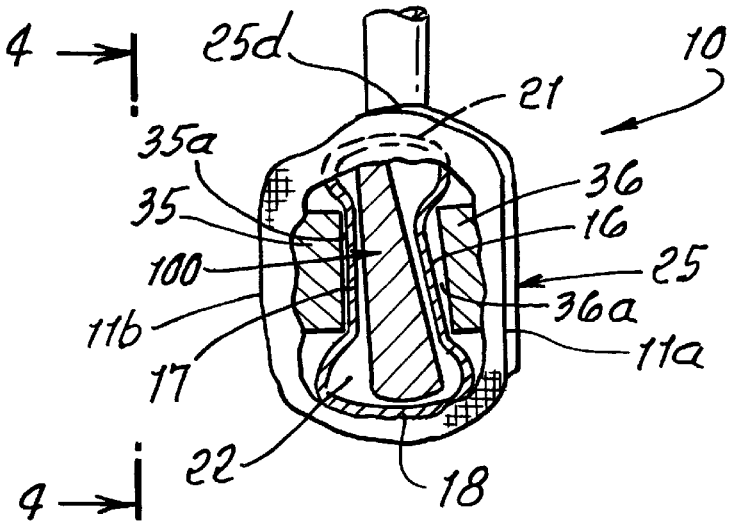
FIG. 2 is a toe end elevation taken on lines 2—2 of FIG. 1.
Figure 5:
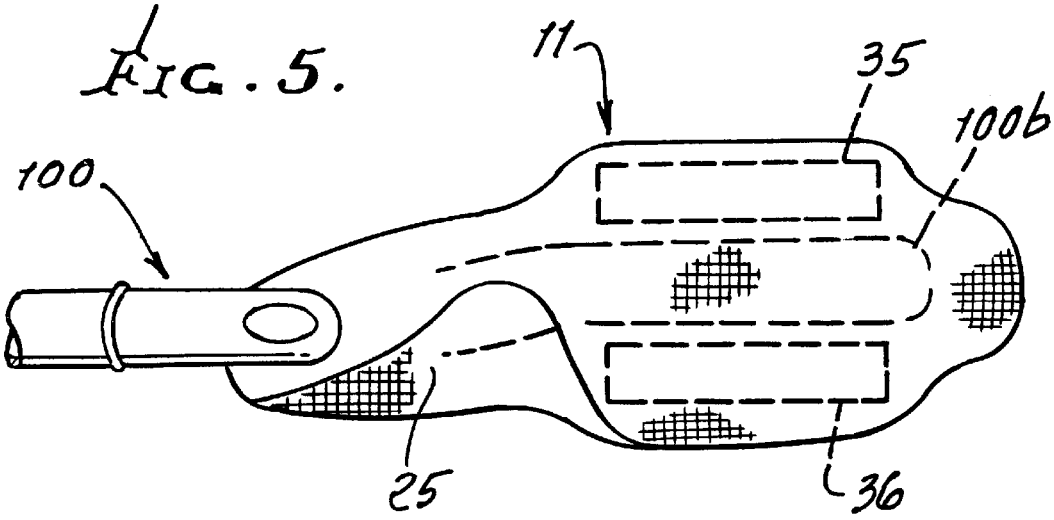
FIG. 5 is a bottom plan view taken on lines 5—5 of FIG. 4.
Figure 6:
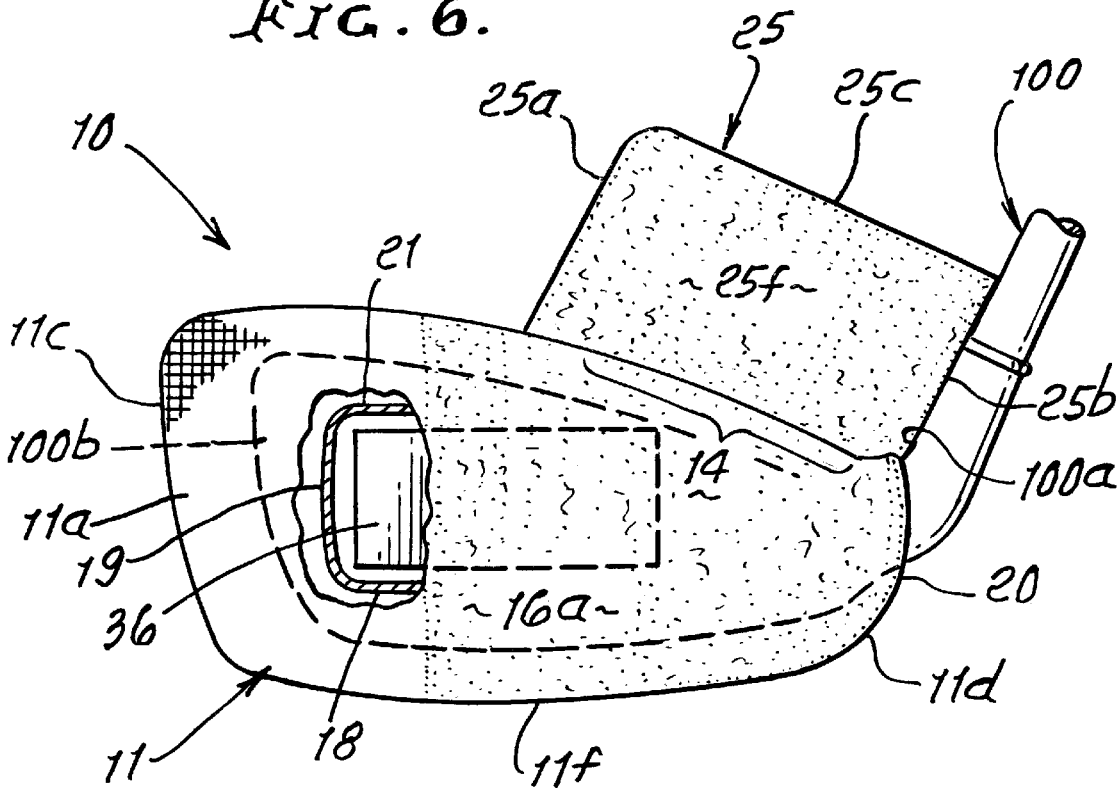
FIG. 6 is a view like FIG. 1, but showing the retainer in unwrapped, open position.

In the example, a retainer in the form of a flap 25 is shown in open, raised position in FIG. 6; and in closed, lowered position in FIG. 1. The flap is or may be integral with the rear side wall portion 17 of the receptacle, and has forward and rearward angled edges 25*a* and 25*b*, and an outer or upper edges (in FIG. 6) 25*c*. When folded downwardly at fold zone 25*d*, rearward edge 25*b*, folds over the hosel upper surface zone 100*a* of a received club head (iron), and then downwardly adjacent the front surface 16*a* of the receptacle front side 11*a*, as indicated in FIG. 1 and FIG. 2. The flap inner surface 25*f* may be retained to front surface 16*a*, as by hook and pile attachment, enabling easy opening and closing of the flap, and its adjustable closing of the opening at 14, as well as tightening to closely fit the receptacle to the club head, while at the same time providing very firm attachment of the device to a club head, presenting loosening and/or detachment, as during club swinging.

Hook or pile structure preferably extends over a major extent of the receptacle front side 11*a*, so that the flap can be adjustably attached in selected positions (tightened or loosened), considering the different sizes of different iron heads and hosels to be protectively confined. Therefore, versatility of the device is enhanced. The majority of opening 14 is covered by the flap in FIG. 1.

Further in accordance with the invention, weighting structure carried by the receptacles to add substantive weight to the head weight, for use in said swinging.

The weighting structure is so carried that it is located at or proximate one of the following:

vii) at least one of said wall portion;

viii) at least two of said wall portions ix) at least three of said wall portions x) at least four of said wall portions.

In FIGS. 1–6, the weighting structure includes two block-like metallic (steel for example) weights 35 and 36 located in pockets 35*a* and 36*a* at opposite sides of the club head 100*b*. Such pockets may be formed by receptacle material at the inner sides of the front and rear wall portions 16 and 17, to position weight 36 in registration with the club head "sweet spot" (central portion of the club face); and to position weight 35 at the opposite side of the head, in sidewise general registration with weight 36. The thickness of each weight is typically less than its length and less than its width, as shown. The pockets may be closed to hold the weights in positions, as described; however, FIG. 9 shows a modified pocket 40 that is open ended at 40*a*, allowing adjustment of the weight position, in directions 41 and 42. The weight 43 may be suitably retained in an adjusted position as by a holder strap 44 attached to the weight, and selectively attached to receptacle wall fabric, as by hook and pile elements, or other structure. FIG. 13 shows two external pockets 48 and 49 on a side 51 of the receptacle fabric, for selective reception of one or both weights 51 and 52. Pockets covers 48*a* and 49*a* may be closed, and held in position by hook and pile elements, or snaps 53, as shown.

Weight material may alternatively consist of metallic granules, or pebbles.

FIG. 7 shows alternative positioning of a weight 60 proximate the toe 61 of the receptacle 62, and proximate the toe 63 of the received club head. Weight 60 is carried in a pocket on the receptacle 62. FIG. 8 shows alternative positioning of a weight 65 proximate the upper edge 66 of the receptacle 64, and proximate the upper edge 67 of the received club head 72. A suitable pocket for weight 70 may be provided. FIG. 11 shows alternative positioning of a weight 70 proximate the heel 71 of the receptacle, and proximate the heel of a received club head. A suitable pocket for weight 70 may be provided.

FIG. 10 shows downward reception of a club head 80 into a receptacle 81, via an elongated top edge slot at 82, defined by the receptacle. Flap 83 carried by the receptacle folds downwardly over the slot, and attaches to the front side 81*a* of the receptacle, as by hook and pile material. Two weights 84 and 85 are carried by the receptacle, adjacent the hosel of the club head, as in suitable pockets. Weights 84 and 85 may be located at opposite sides of the hosel, and interconnected.

FIG. 12 shows weight holder 90 carried by a bracket 91 that fits over a club head 96. Straps 92 have ends 92*a* attached to one side 91*a* of the bracket, and fold over the open side of the bracket to attach to the opposite side 91*b* of the bracket. Retained weights appear at 95.

Finally, the weights 35 and 36 may be joined together, as by a bend that extends at the exterior of the club head.

Figure 14:
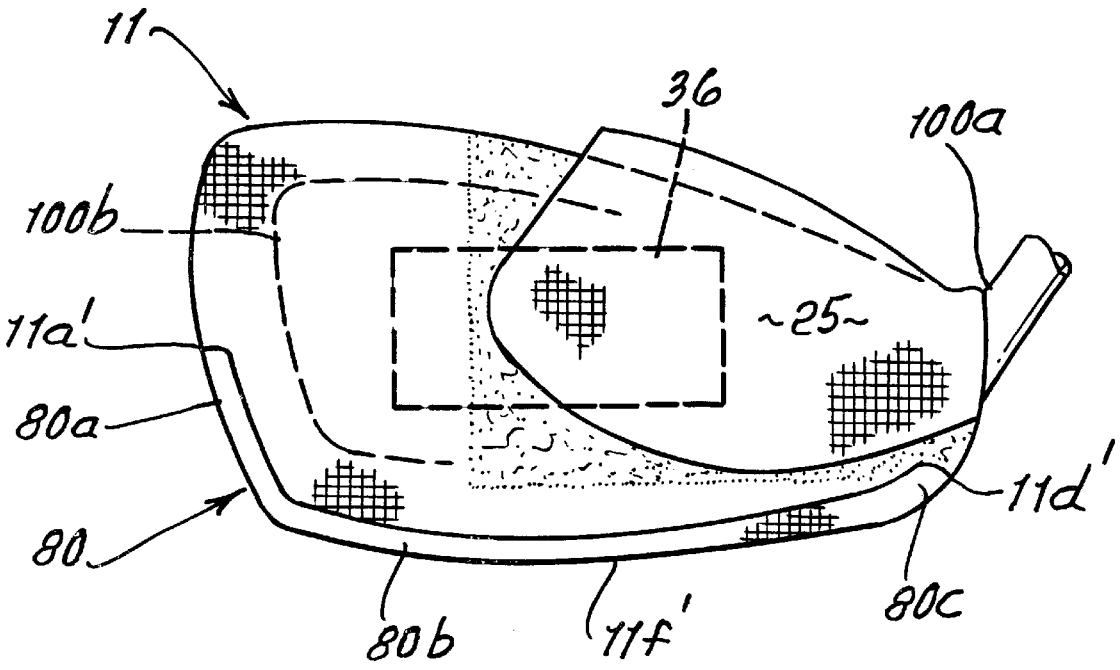

Referring to FIG. 14, it is a view like FIG. 1; however, it shows a scuff protector at a periphery or peripheries of the receptacles to protect said periphery or peripheries against scuffing in the event of contact with a surface as during swinging of the club.

As shown the scuff protector 80 extends at 80*a*, 80*b* and 80*c*, or any of those locations. They are defined as:

$x_1$) lowermost extent of the receptacle, as along its lower edge 11*f*', $x_2$) a toe portion of the receptacle, as at 11*a*'

$x_3$) a lower heel portion of the receptacle 11*d*'.

The protector is made of scuff resistant material (plastic, metal, or other).

Figure 15:
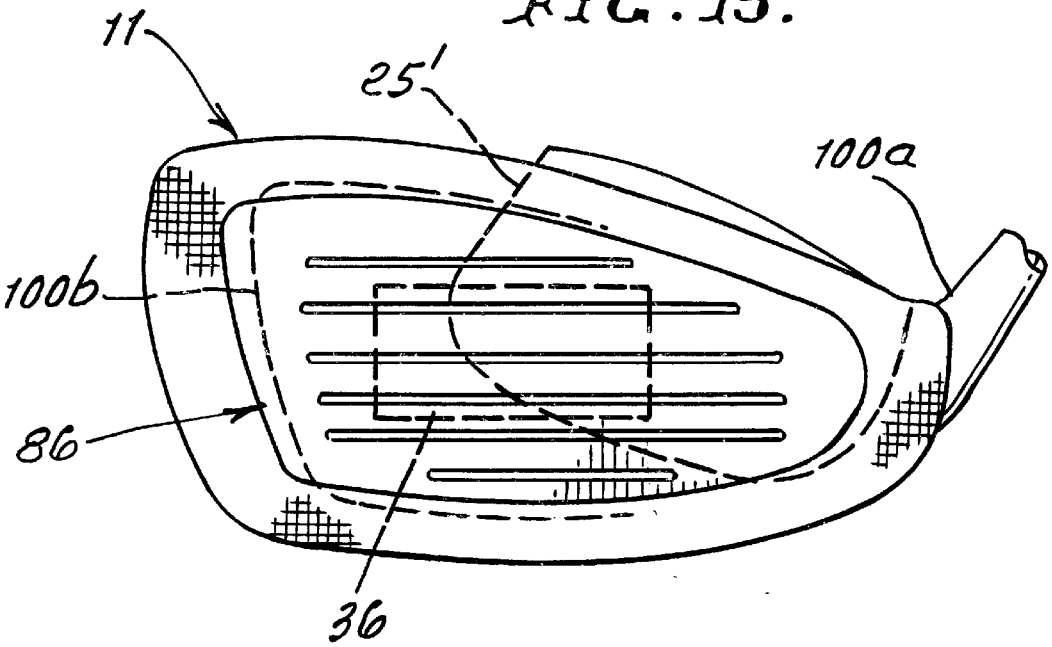

Referring to FIG. 15, it is a view like FIG. 1, however, it shows a striker 86 on the front of the receptacle 11, for striking impact with a ball, during swinging of the club. It may consist of a plate, as for example consisting of metal, plastic, or other material. The striker is located and attached to the receptacle to register with the front face including the sweet spot, of the golf club head 100*b* received in receptacles. The flap 25' folds over the top of the head, to the rear side thereof, so as not to interfere with the striker.

In a preferred form of the invention, the weighting structure is sized and snugly positioned and retained proximate at least one of the following portions of a club head received in the receptacle:

i) front side portion ii) rear side portion iii) toe portion iv) heel portion v) top portion vi) bottom portion

I claim:

1. A weighting device for use on a golf club head as during swinging of the club, the club head having a toe and an edge angled downwardly and toward the position of the head hosel, comprising in combination:

a) a receptacle having an opening via which the club head is to be received into the receptacle, b) a retainer carried on the receptacle to be fastened in a position for retaining the receptacle in generally fitting relation to the club head when received, c) and weighting structure carried by the receptacle to add substantial weight to the club head, for use as in club swinging, d) said receptacle having a front portion, a bottom portion, a toe portion, a heel portion, a back portion, a top portion, and an outer side portion extending between said top and bottom portions, and said weighting structure located proximate at least one of said portions, e) said retainer comprising a flap connected to the receptacle to fold and at least partly cover said opening, said fold extending and angled at least in part substantially parallel to a head edge as it approaches the hosel when received, f) said flap having a free end portion releasably connected to said receptable side portion.

2. The combination of claim 1 including hook and pile fastening materials for fastening said retainer in said position.

3. The combination of claim 2 wherein one of said hook and pile materials is on said flap and the other of said hook and pile materials is on said receptacle outer side portion and sized to have greater area than the area of said one material on the flap, providing flap position adjustability.

4. The combination of claim 1 wherein said flap extends at least part way about the receptacle.

5. The combination of claim 4 wherein said flap covers substantially all of said opening extending from said hosel and directionally toward said receptacle toe portion, in said fastened position.

6. The combination of claim 1 wherein said receptacle has at least two of the following:

i) a wall portion to extend adjacent the front face of the club head ii) a wall portion to extend adjacent the rear side of the club head iii) a wall portion to extend adjacent the bottom surface of the club head iv) a wall portion to extend adjacent the toe of the club head v) a wall portion to extend adjacent the heel of the club head vi) a wall portion to extend adjacent the top edge of the club head;

and said weighting structure is located at or proximate at least one of said wall portions.

7. The combination of claim 6 wherein said weighting structure is located at or proximate one of the following:

vii) at least one of said wall portions, viii) at least two of said wall portions ix) at least three of said wall portions x) at least four of said wall portions.

8. The combination of claim 7 wherein said weighting structure includes separate local metallic portions.

9. The combination of claim 1 wherein said weighting structure includes metallic material.

10. The combination of claim 9 wherein said material is concealed by said receptacle.

11. The combination of claim 9 wherein said material is held in a pocket or pockets provided by the receptacle.

12. The combination of claim 9 including a club head received in the receptacle, and wherein said material is received in pockets at opposite sides of the club head.

13. The combination of claim 9 wherein said material is received in a pocket provided by the receptacle, the pocket sized to enable adjustment of the position of the material, relative to the pocket.

14. The combination of claim 9 wherein the material is received in a pocket or pockets provided by the receptacle, to enable selective use of the pocket or pockets of the material.

15. The combination of claim 1 including a scuff protector at a periphery or peripheries of the receptacles to protect said periphery or peripheries against scuffing in the event of contact with a surface as during swinging of the club.

16. The combination of claim 15 wherein said scuff protector extends at one of the following:

$x_1$) a lowermost extent of the receptacle $x_2$) a toe portion of the receptacle $x_3$) a lower heel portion of the receptacle.

17. The combination of claim 1 including a striker at a front side of the receptacle, for striking impact with a ball, during swinging of the club.

18. The combination of claim 17 wherein said striker comprises a plate.

19. The combination of claim 1 wherein said weighting structure is sized and snugly positioned and retained proximate at least one of the following portions of a club head received in the receptacle:

i) front side portion ii) rear side portion iii) toe portion iv) heel portion v) top portion vi) bottom portion.

* * * * *